US006059407A

United States Patent [19]

Komatsu et al.

[11] Patent Number: 6,059,407

[45] Date of Patent: May 9, 2000

[54] METHOD AND DEVICE FOR INK JET RECORDING

[75] Inventors: Hidehiko Komatsu; Hideo Yamazaki; Tatsuya Ito; Hiromu Hirabayashi, all of Suwa, Japan

[73] Assignee: Seiko Epson Corporation, Tokyo-to, Japan

[21] Appl. No.: 08/787,884

[22] Filed: Jan. 23, 1997

Related U.S. Application Data

[63] Continuation of application No. 08/105,499, Aug. 11, 1993.

[30] Foreign Application Priority Data

| | | | |
|---|---|---|---|
| Aug. 12, 1992 | [JP] | Japan | 4-215259 |
| Aug. 12, 1992 | [JP] | Japan | 4-215260 |
| Aug. 12, 1992 | [JP] | Japan | 4-215261 |
| Jul. 14, 1993 | [JP] | Japan | 5-174024 |

[51] Int. Cl.[7] ..... B41J 2/01

[52] U.S. Cl. ..... 347/103

[58] Field of Search ..... 347/103, 163, 347/104, 100; 399/139; 428/195; 430/138, 48

[56] References Cited

U.S. PATENT DOCUMENTS

| | | | |
|---|---|---|---|
| 3,857,722 | 12/1974 | Wright | 430/48 |
| 4,620,876 | 11/1986 | Fujii et al. | 106/31.51 |
| 5,099,256 | 3/1992 | Anderson | 347/103 |
| 5,221,288 | 6/1993 | Kamata et al. | 8/554 |
| 5,371,139 | 12/1994 | Yokoyama et al. | 524/755 |

FOREIGN PATENT DOCUMENTS

| | | |
|---|---|---|
| 674887 | of 0000 | Belgium . |
| 01146750 | of 0000 | Japan . |
| 62144986 | of 0000 | Japan . |
| 1131638 | of 0000 | United Kingdom . |
| 9307000 | of 0000 | WIPO . |

OTHER PUBLICATIONS

Encyclopedia of Chemical Technology, 3rd Edition. Vol. 8, Diuretics to Emulsions; Kirk–Othmer. John Wiley & Sons, pp. 910–918.

Encyclopedia of Chemical Technology 3rd Edition, vol. 20, Refractories to Silk; Kirk–Othmer. John Wiley & Sons, pp. 223–225, 1982.

The Condensed Encyclopedia of Surfactants, Michael and Irene Ash Oct. 16, 1992.

Patent Abstracts of Japan, vol. 13, No. 405 (M–868) (3753) Sep. 7, 1989.

Patent Abstracts of Japan, vol. 11, No. 372 (M–648) Dec. 4, 1987.

Encyclopedia of Chemical Technology, Kirk–Othmer, "Diuretics to Emulsions" 3 Edtion vol. 8, John Wiley & Son p. 910–9.

Encyclopedia of Chemical Technology, Kirk–Othmer "Refractories to Silk" 3 Edition, vol. 20, John Wiley & Sons, p. 223–2.

The Condensed Encyclopedia, Compiled by M & I Ash, 1989, Chemical Publishing Co., Inc., 2 Sheets.

Solvent Properties of Surfactant Solutions "Nonionic Surfactants" Edited by Martin Schick, 1967, 5 Sheets.

*Primary Examiner*—Benjamin R. Fuller
*Assistant Examiner*—Raquel Yvette Gordon
*Attorney, Agent, or Firm*—Ladas & Parry

[57] ABSTRACT

An intermediate transfer ink jet recording method comprising forming an ink image on an intermediate transfer medium by ink jet recording and then transferring the ink image from the intermediate transfer medium onto a recording medium, which method enables an excellent image to be formed on the intermediate transfer medium and the image to be efficiently transferred from the intermediate transfer medium to the recording medium. The intermediate transfer ink jet recording method of the invention is characterized by ejecting an ink composition on an intermediate transfer medium carrying, on the surface thereof, a surfactant having an HLB value of 2 to 15 to form an ink image and transferring the ink image formed on the intermediate transfer medium to a recording medium.

8 Claims, 5 Drawing Sheets

METHOD AND DEVICE FOR INK JET RECORDING

This application is a continuation of copending application Ser. No. 08/105,499 filed on Aug. 11, 1993.

BACKGROUND OF THE INVENTION

1. Field of the Invention

The present invention relates to an intermediate transfer ink jet recording method and a device for practicing said method, and more particularly to an ink jet recording method comprising forming an ink image on an intermediate transfer medium by ink jet recording and transferring the ink image to a recording medium, and a device for practicing said method.

2. Background Art

An ink jet recording system is advantageously excellent in the simplicity of the mechanism and noiseless. This type of printing, however, has problems including that the quality of prints varies depending upon the kinds of recording media, for example, the quality of recording paper and the image of a portion remaining undried of an ink image is disturbed during the discharge of the recording medium.

In order to solve such problems, a proposal has been made on a method called an "intermediate transfer system" wherein an ink image is once formed on a transfer medium by an ink jet recording system and then transferred to a recording medium (see U.S. Pat. Nos. 4,538,156 and 5,099,256). In this method, the recording head can be disposed apart from the recording paper. Consequently, this method has a feature that it is possible to prevent the contact of the recording head with the recording paper caused by the disposition of the recording head in close proximity to the recording paper or the clogging of the recording head attributable to the collection of paper lint on the recording head.

The above-described device should satisfy both a requirement that a desired ink image is accurately formed on an intermediate transfer medium and a requirement that the ink image is transferred to the recording medium under low pressure with a good efficiency. With respect to the former requirement, if ink droplets ejected on the intermediate transfer medium are excessively spread or flowed on the intermediate transfer medium to cause a remarkable variation in the location or shape thereof, the resultant print is unfavorably disturbed. In the present specification, this phenomenon is often referred to as "repelling" of the ink. For example, FIG. 9 schematically shows a straight line printed by a group of dots. When a group of dots as shown in FIG. 9(*a*) is formed onto an intermediate transfer medium, a good print can be provided on a recording medium. On the other hand, as shown in FIG. 9(*b*), when there occurs the "repelling" phenomenon wherein a dot is excessively broadened or flowed outside a region indicated by a broken line where the dots are to be formed, no good print can be provided on the recording medium. With respect to the latter requirement, printing cannot be effected with a high efficiency if the ink image remains on the intermediate transfer medium or if a high pressure is necessary for the transfer.

Japanese Patent Laid-Open No. 146750/1989 discloses a method which comprises forming a thin film of glycerin on a transfer medium and forming an ink image of an oil-base ink on the thin film. According to this method, it is possible to accurately form an ink image and to transfer the ink image to the recording medium under relatively low pressure with a high efficiency.

However, the present inventors have confirmed that, when this method is effected by using a water-base ink composition containing water as a main solvent, in some cases, the transfer cannot be often effected with a high efficiency as opposed to the oil-base ink.

Furthermore, in the conventional recording method, a linear load (the force per unit length) of about 2.5 kg/cm may be required. If it is possible to effect the transfer under lower pressure, the limitation on the material for constituting the device can be eliminated, so that a device having a lower weight and a smaller size could be realized.

SUMMARY OF THE INVENTION

Accordingly, an object of the present invention is to provide an intermediate transfer ink jet recording method which enables a print to be obtained with a high efficiency when a water-base ink composition is employed.

According to one aspect of the present invention, there is provided an intermediate transfer ink jet recording method comprising the steps of:

ejecting an ink composition on an intermediate transfer medium carrying, on the surface thereof, a surfactant having an HLB value of 2 to 15, to form an ink image; and transferring said ink image formed on said intermediate transfer medium to a recording medium.

According to another aspect of the present invention, there is provided an intermediate transfer ink jet recording device comprising:

an intermediate transfer medium carrying, on the surface thereof, a surfactant having an HLB value of 2 to 15;

recording means for ejecting droplets of an ink composition to form an ink image on said intermediate transfer medium; and transfer means for pressing said ink image formed on said intermediate transfer medium against a recording medium to transfer said ink image to said recording medium.

DETAILED DESCRIPTION OF THE INVENTION (Surfactant)

In the recording method according to the present invention, a surfactant having an HLB (hydrophilic-lipophilic balance) value of 2 to 15, preferably 4 to 13, is employed. Preferred examples of the surfactant include cationic surfactants (for example, an aliphatic amine salt and its quaternary ammonium salt, an aromatic quaternary ammonium salt and a heterocyclic quaternary ammonium salt), anionic surfactants (for example, a salt of an alkylcarboxylic acid, an alkyl ether carboxylic acid, an alkylbenzenesulfonic acid, an alkylnaphthalenesulfonic acid, a dialkylsulfosuccinic acid, a higher alcohol sulfuric acid ester, an alkyl ether sulfuric acid, an alkyl ether phosphoric acid ester or an alkylphosphoric acid ester), nonionic surfactants (for example, ethers such as alkyl and alkyl allyl polyoxyethylene ethers; ether esters such as a polyoxy ethylene ether of a glycerin ester; esters such as a fatty acid ester of polyethylene glycol; and nitrogen-containing compounds such as a fatty acid alkanolamide), amphoteric surfactants (for example, a carboxybetaine, a salt of an aminocarboxylic acid and an imidazoline derivative), a silicone surfactant and a fluorosurfactant (particularly preferably one wherein all the hydrogen atoms of the hydrocarbon chain are substituted with a fluorine atom). The surfactant is also commercially available. Preferred examples thereof include Neocol YSK (HLB value: 11; the following values within the parentheses representing HLB values), and Hitenol N-17 (14) (all the above products being an anionic surfactant manufactured by Dai-Ichi Kogyo Seiyaku Co., Ltd.), Noigen EA-50 (6), Noigen A-140 (14), Sorgen 30 (4), Epan 420 (9) and Epan 740 (13) (all the above products being a nonionic surfactant manufactured by Dai-Ichi Kogyo Seiyaku Co., Ltd.), L-7001 (7), L-7602 (8), L-7604 (13), Fz-2171 (2), Fz-2163 (13) and Fz-2164 (8) (all the above products being a silicone surfactant manufactured by Nippon Unicar Co., Ltd.) and FC-430 (12) (a fluorosurfactant manufactured by Sumitomo 3M Co., Ltd.). (Recording Method and Device)

The ink jet recording method and apparatus according to the present invention will now be described with reference to the accompanying drawings.

Figure 1:
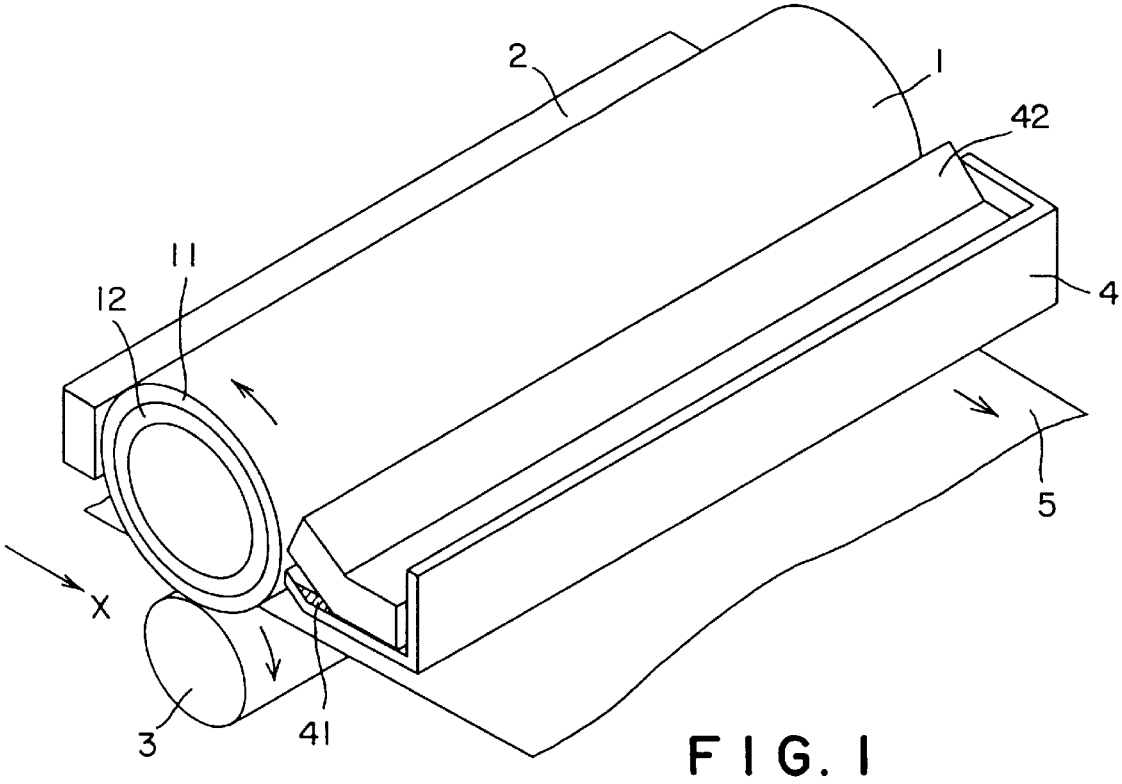
FIG. 1 is a perspective view of an embodiment of the recording device according to the present invention, wherein a surfactant 41 is coated on a transfer drum 1 by means of a wick 42.
Figure 2:
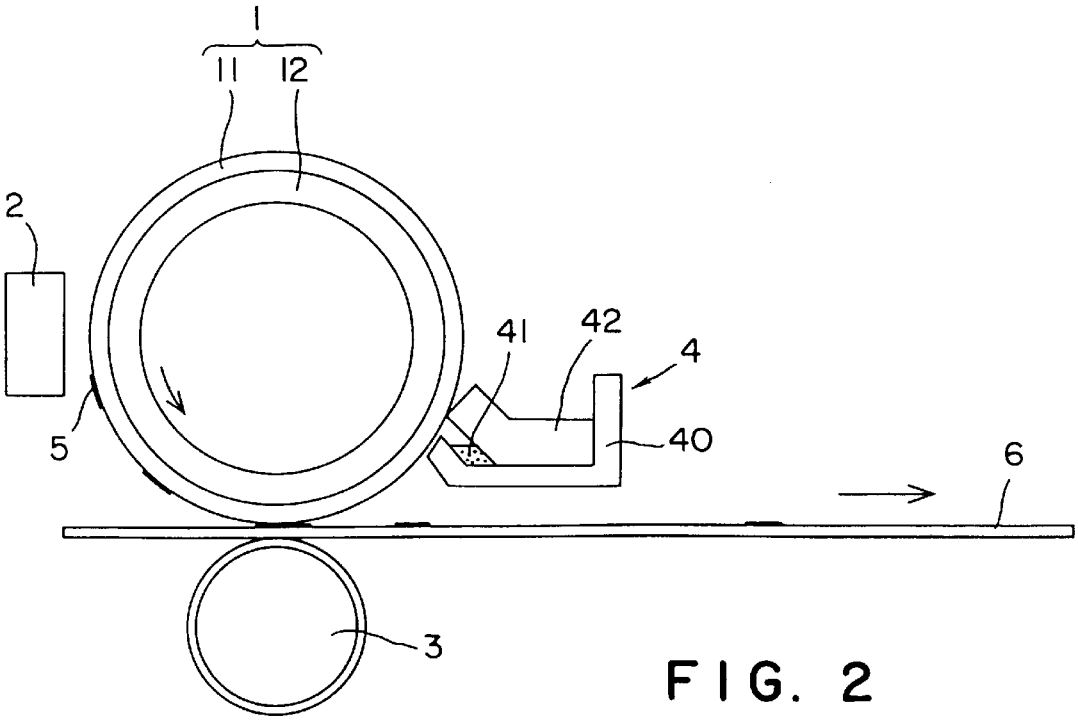
FIG. 2 is a cross-sectional view in the direction of X of the device shown in FIG. 1.

FIG. 1 is a perspective view of an embodiment of the ink jet recording device according to the present invention, and FIG. 2 is a cross-sectional view in the direction of X of the device shown in FIG. 1. This device comprises a transfer drum 1 as an intermediate transfer medium and, disposed around the transfer drum 1, ink jet recording means (an ink jet recording head) 2 and a pressure roller 3 and further comprises a surfactant coating device 4 provided upstream of the recording head 2 in the direction of rotation of the transfer drum.

The transfer drum 1 comprises an elastic layer 11 constituting the surface of the drum 1 and an internal drum 12. The elastic layer 11 preferably comprises a rubber material, particularly preferably comprises a material that permits an ink image to be easily peeled off therefrom and is heat-resistant. Preferred examples of the rubber material include a silicone rubber, a fluorosilicone rubber, phenylsilicone rubber, a fluororubber, a chloroprene rubber, a nitrile rubber, an ethylene/propylene rubber, a natural rubber, a styrene rubber, an isoprene rubber, a butadiene rubber, an ethylene/propylene/butadiene polymer and a nitrile/butadiene rubber. A silicone rubber, a fluorosilicone rubber, a fluororubber, phenylsilicone rubber and a chloroprene rubber are particularly preferred.

The recording head 2 selectively ejects ink droplets according to printing signals and comprises an ink jet recording head using, for example, a piezoelectric element. In the device shown in FIGS. 1 and 2, a recording head having a nozzle over substantially the whole width of the transfer drum 1 is used.

The pressure roller 3 is preferably a metallic roller and pressed against the transfer drum 1 by pressure applying means (not shown).

The surfactant coating device 4 comprises a container 40 which contains a surfactant 41 and a liquid absorbent wick 42 constructed in such a manner that one end of the wick is immersed in the surfactant 41 and a part thereof is in contact with the elastic layer 11. As shown in the drawing, this wick is constructed so as to have its width over substantially the whole width of the transfer drum 1 or at least over the whole width of the printing region, and preferably comprises a felt material.

In the above-described device, printing is effected as follows. At the outset, the surfactant 41 is sucked through the capillarity of the wick 42 and coated on the surface of the elastic layer 11 by means of the wick 42. An ink image 5 is formed on the coated surface by the ink jet recording head 2. The presence of the surfactant prevents the ink image 5 from being excessively broadened or flowed, so that the ink image 5 can be formed at an accurate position without a significant variation in the location of the ink image. This ink image is carried to a region facing the pressure roller 3 with the rotation of the transfer drum 1 and transferred to the recording medium 6. In this case, the ink image 5 can be thoroughly peeled off from the intermediate transfer drum 1 by virtue of the presence of the surfactant. Thus, printing can be effected without leaving the ink image unpeeled. The transfer drum 1 after the completion of the transfer step comes again into contact with the surfactant coating device 4 which cleans the surface of the transfer drum 1 to render the transfer drum 1 ready for the next image formation. It is needless to say that the surfactant is preferably coated over the whole region where the ink image is formed.

Figure 3:
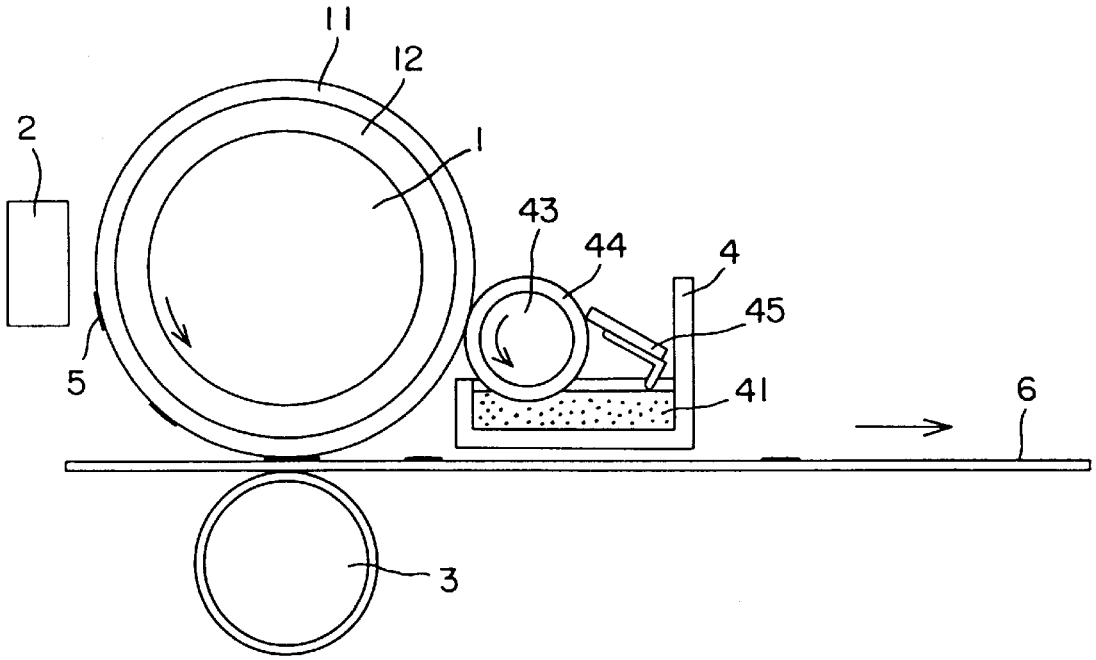
FIG. 3 is a cross-sectional view of another preferred embodiment of the recording device according to the present invention, wherein a surfactant 41 is coated on a transfer drum 1 by means of a roller 43.

According to a further preferred embodiment of the present invention, the surfactant coating device 4 may be constructed as shown in FIG. 3. Specifically, the surfactant may be coated using, instead of the wick 42 shown in FIG. 2, a coating roller 43 provided with an absorbent layer (preferably comprising a sponge) 44. In this device, the absorption of the surfactant into the absorbent layer 44 may be regulated by providing a regulating blade 45.

Figure 4:
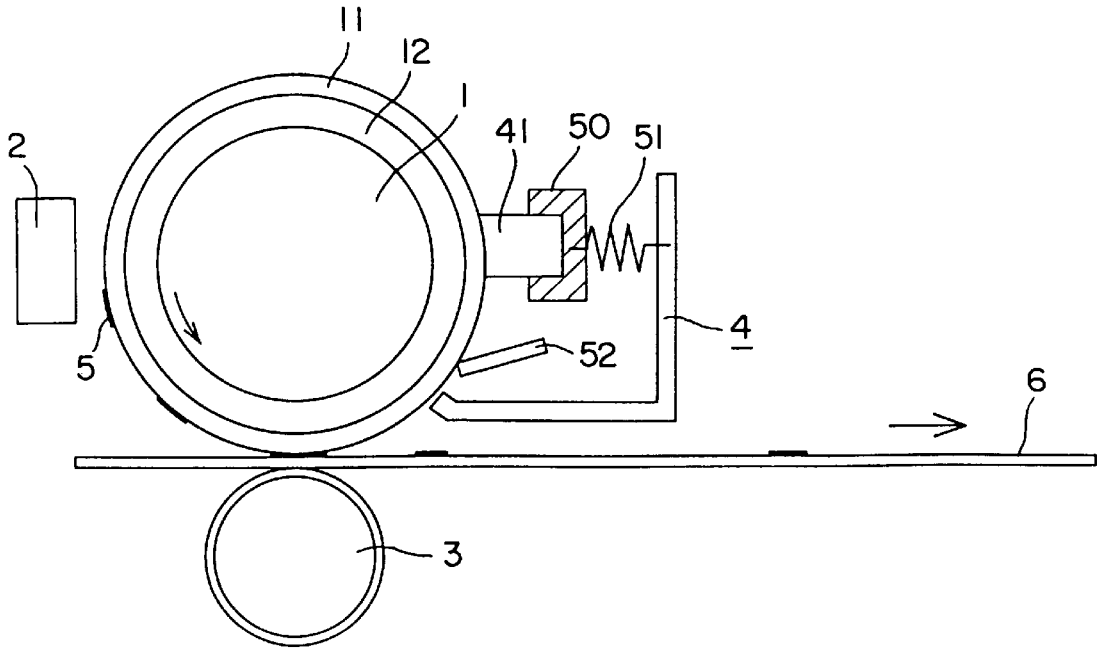
FIG. 4 is a cross-sectional view of a further preferred embodiment of the recording device according to the present invention, wherein a solid surfactant 41 is coated on a transfer drum 1.

According to a further preferred embodiment of the present invention, when the surfactant is solid at room temperature, the surfactant coating device 4 may be constructed as shown in FIG. 4. Specifically, in the device shown in FIG. 4, the solid surfactant 41 may be coated by bringing the solid surfactant 41 into contact with the elastic layer 11 by means of a press spring 51 with the solid surfactant 41 supported by a supporting member 50. In this construction, the surface of the transfer drum 1 after the completion of the transfer is cleaned by a cleaner blade 52.

According to a further embodiment of the present invention, the surfactant may be previously incorporated into the elastic layer by milling or other means. Specifically, a rubber material is mixed with a surfactant. The mixture is vulcanized to provide a rubber material for constituting the elastic layer. According to a still preferred embodiment of the present invention, it is preferred for the rubber material to have a low compatibility with the surfactant. This is because, when the rubber material and surfactant are less compatible with each other, it is considered that the surfactant is fed little by little onto the surface of the elastic layer, which enables the surface to be maintained in a good state. The amount of addition of the surfactant is preferably about 1 to 15% by weight, still preferably about 3 to 10% by weight, based on the rubber material.

In the present invention, it is possible to transfer the ink image onto the intermediate transfer medium under a pressure of about 1 to 0.5 kg/cm in terms of the linear load. In conventional methods, it is difficult to transfer the ink image onto the recording medium under such a low pressure without leaving any residual ink image on the intermediate transfer medium. Since the transfer can be effected under the above low pressure, the strength required of the individual members of the device of the present invention is not so large that, for example, the present invention is advantageous also in that the size of the whole device can be reduced.

According to a preferred embodiment of the present invention, it is also possible to use a method wherein the ink image transferred to the recording medium is then heated and further optionally pressed to surely fix the ink image to the recording medium.

Figure 5:
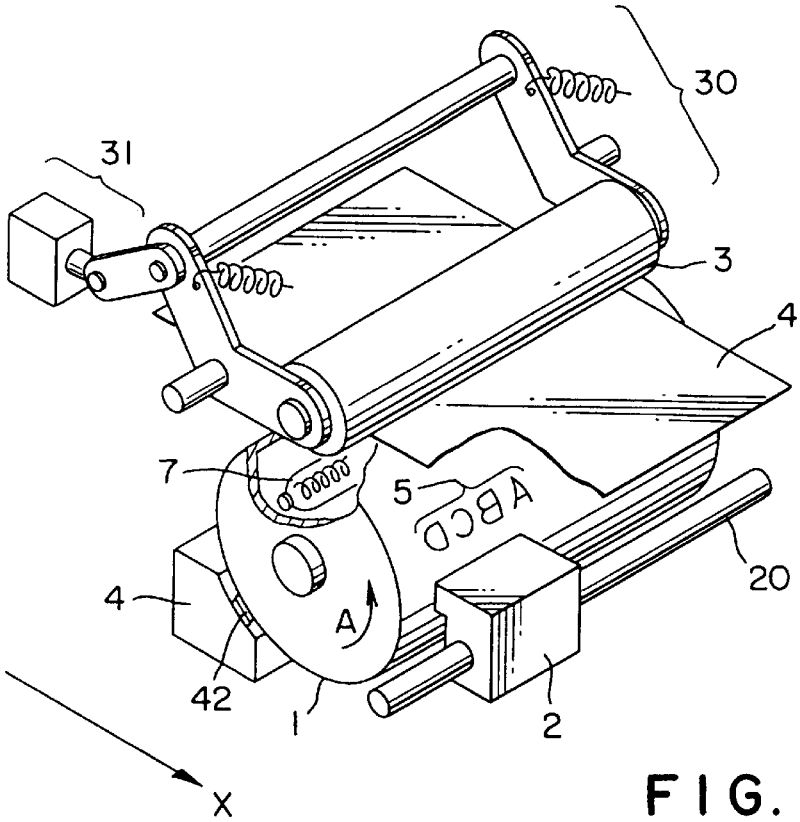
FIG. 5 is a perspective view of a further embodiment of the recording device according to the present invention, wherein a heater 5 for heating an ink image is provided.
Figure 6:
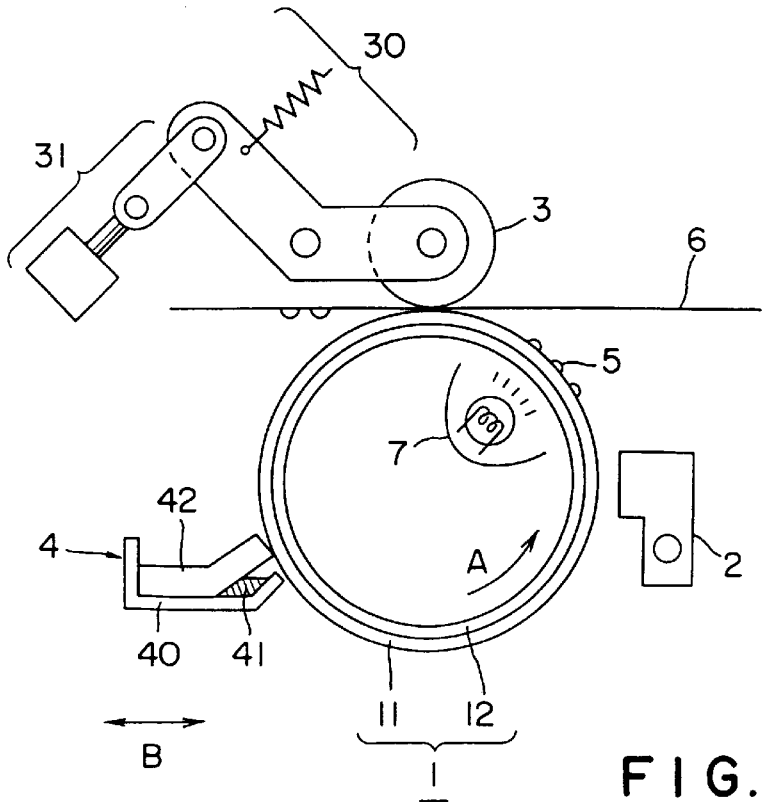
FIG. 6 is a cross-sectional view in the direction of X of the device shown in FIG. 5.

According to a further preferred embodiment of the present invention, means for heating the ink image formed on the intermediate transfer medium is provided to heat the ink image on the intermediate transfer medium. FIG. 5 is a perspective view of a further embodiment of the recording device according to the present invention, wherein a heater 7 is provided as the heating means, and FIG. 6 is a cross-sectional view in the direction of X of the device shown in FIG. 5.

In this device, printing is effected as follows. At the outset, the pressure drum 3 is disposed so as not to come into contact with the transfer drum 1 by pressure release means 31. A surfactant is coated on the transfer drum 1 by the surfactant coating device 4. In this device, the surfactant coating device 4 can be disposed in such a manner that it is apart from and does not come into contact with the transfer drum 1. Specifically, it can be moved in a direction indicated by an arrow B shown in FIG. 6. After the completion of coating of the surfactant, the surfactant coating device 4 is brought into non-contact with the transfer drum 1. Subsequently, an image 5 is formed on the transfer drum 1 while scanning the ink jet recording head 2 in a reciprocating manner along a carriage 20. The ink image 5 formed on the transfer drum 1 is heated with heating means 7 to evaporate a volatile solvent component contained in the ink image. As a result, the surface of the ink image 5 becomes viscous, which facilitates the transfer of the ink image to the recording medium. Specifically, the ink image is pressed against the recording medium 6 between the pressure drum 3 and the transfer drum 1 by means of press means 30, so that the ink image is transferred onto the recording medium.

Figure 7:
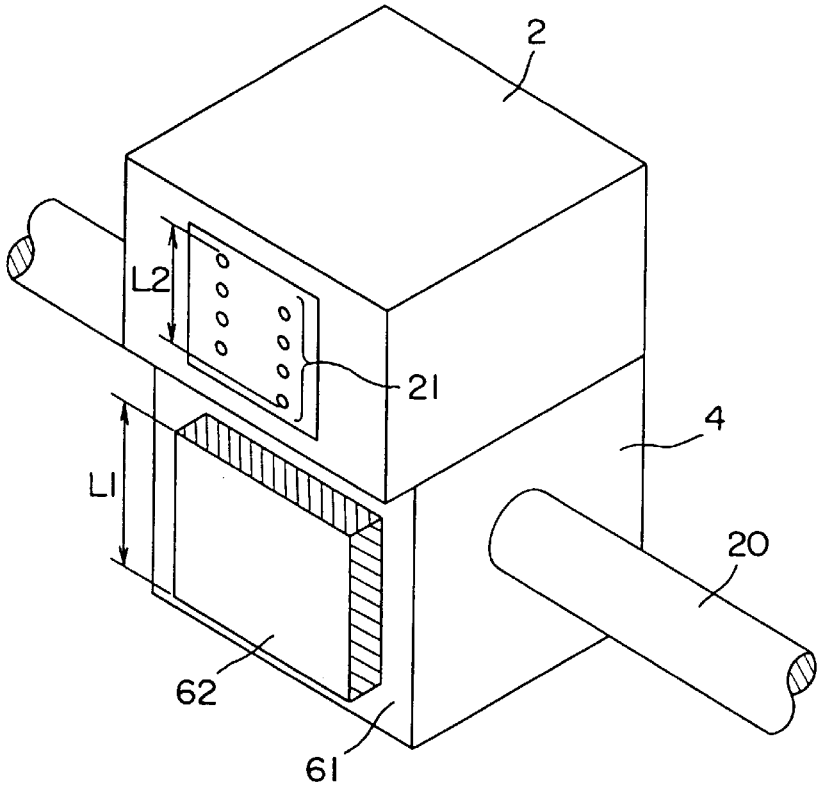
FIG. 7 is an embodiment of the device according to the present invention, wherein a recording head is integrally attached to a surfactant coating device.
Figure 8:
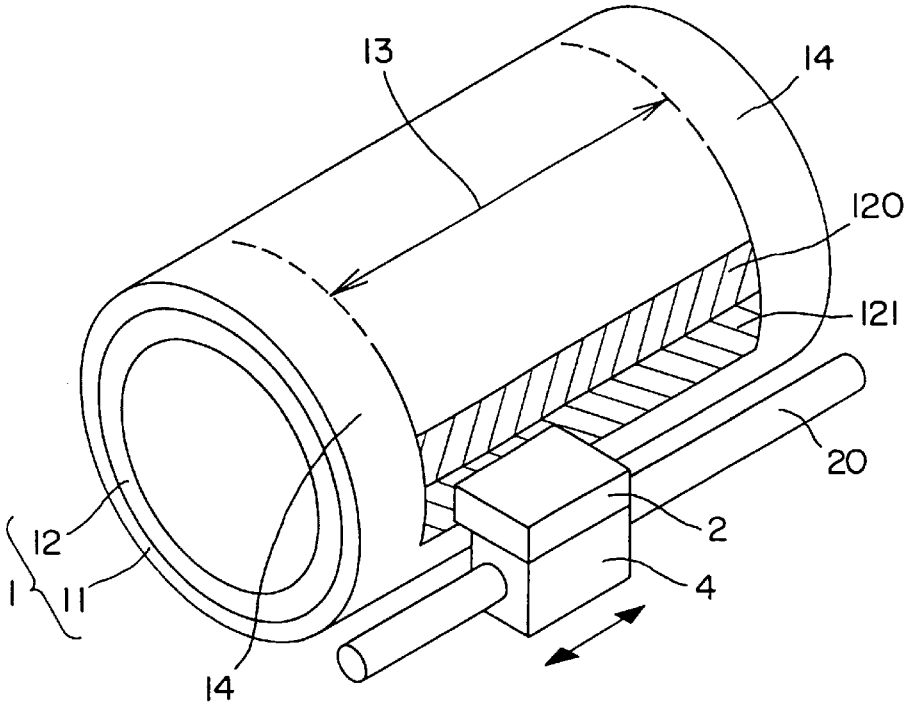
FIG. 8 is a diagram for explaining a recording method using the device shown in FIG. 7.
Figure 9:
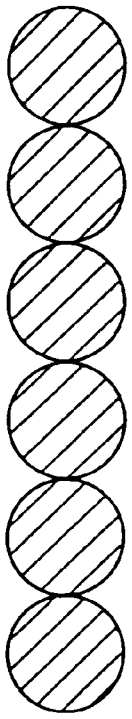
FIGS. 9(*a*) and 9(*b*) are diagrams of a straight line formed by a group of dots on a recording medium, wherein FIG. 9(*a*) represents an ideal group of dots and FIG. 9(*b*) represents a group of dots wherein repelling is observed.
Figure 9:
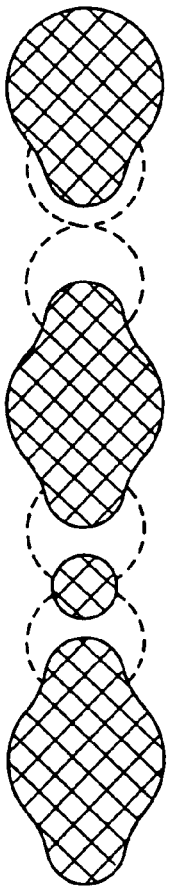

According to a further preferred embodiment of the present invention, the recording head 2 is constructed integrally with the surfactant coating device 4. The coating of the surfactant and printing are effected while scanning the combined recording head and surfactant coating device along the carriage 20. A surfactant coating device 4 constructed integrally with the recording head 2 is schematically shown in FIG. 7. This device is constructed so that the surfactant is contained in a container 61, infiltrated into a pad 62 (preferably comprising a sponge) permeable to a liquid and oozes on the surface of the pad. As shown in FIG. 8, the recording head 2 and the coating device 4 are scanned along the carriage 20. When the combined recording head and surfactant coating device is in a printing region 13 on the recording medium, the recording head 2 effects printing on a region 120, while the coating device 4 coats a surfactant on a region 121. During this step, the transfer drum 1 remains stopped. When the recording head 2 and the coating device 4 have reached a non-printing region, the transfer drum 1 is rotated by a given angle. The recording head 2 and the coating device 4 enter again the printing region 13 for new printing and coating of the surfactant. Printing is effected on the region 121 coated with the surfactant, and coating of the surfactant is effected on a new region. The width L1 coated by the pad 62 is preferably larger than the width L2 of a group of nozzles 21 of the recording head 2.

(Ink Composition)

The ink composition used in the method of the present invention is the so-called "water-base ink composition" and not particularly limited so far as it can be used in an intermediate transfer ink jet recording method. Specific examples of the ink composition include an ink composition comprising a colorant, water as a main solvent, a water-soluble organic solvent and other additives.

More specifically, preferred examples of the water-soluble organic solvent include polyhydric alcohols having a high boiling point and a low volatility, such as glycerin, ethylene glycol, diethylene glycol, triethylene glycol, propylene glycol, dipropylene glycol, hexylene glycol, polyethylene glycol and polypropylene glycol. Further examples of the water-soluble organic solvent include monoetherification products, dietherification products and esterification products of the above polyhydric alcohols, such as ethylene glycol monomethyl ether, ethylene glycol monoethyl ether, ethylene glycol monobutyl ether, diethylene glycol monomethyl ether, diethylene glycol monoethyl ether and diethylene glycol monobutyl ether. It is also possible to use N-methyl-2-pyrrolidone, 1,3-dimethylimidazolidinone, monoethanolamine, N,N-dimethylethanolamine, N,N-diethylethanolamine, diethanolamine, N-n-butyldiethanolamine, tri-iso-propanolamine and triethanolamine. The water-soluble organic solvent serves to improve the moisture retention of the ink, which prevents clogging of the nozzles and contributes to an improvement in the stability of the ink.

Further, the addition of monohydric alcohols such as ethanol, propanol, isopropanol and butanol is preferred from the viewpoint of improving the quick drying and fixing of prints.

Examples of the colorant include a pigment and a dye.

Examples of the pigment include organic pigments and inorganic pigments. Preferred specific examples of pigments for a black ink include carbon black (C.I. Pigment Black 7), such as furnace black, lamp black, acetylene black and channel black, metals, such as copper, iron (C.I. Pigment Black 11) and titanium oxide, and organic pigments, such as aniline black (C.I. Pigment Black 1). Preferred specific examples of the pigment for a color ink include C.I. Pigment Yellow 1 (fast yellow G), 3 and 12 (disazo yellow AAA), 13, 14, 17, 24, 34, 35, 37 and 42 (iron oxide yellow), 53, 55, 81 and 83 (disazo yellow HR), 95, 97, 98, 100, 101, 104, 108, 109, 110, 117, 120, 138 and 153, C.I. Pigment Orange 5, 13, 16, 17, 36, 43 and 51, C.I. Pigment Red 1, 2, 3, 5, 17 and 22 (brilliant fast scarlet), 23, 31, 38 and 48:2 (permanent red 2B (Ba)), 48:2 (permanent red 2B (Ca)), 48:3 (permanent red 2B (Sr)), 48:4 (permanent red 2B (Mn)), 49:1, 52:2, 53:1 and 57:1 (brilliant carmine 6B), 60:1, 63:1, 63:2, 64:1 and 81 (rhodamine 6G lake), 83, 88 and 101 (iron oxide red), 104, 105, 106 and 108 (cadmium red), 112, 114 and 122 (quinacridone magenta), 123, 146, 149, 166, 168, 170, 172, 177, 178, 179, 185, 190, 193, 209 and 219, C.I. Pigment Violet 1 (rhodamine lake), 3, 5:1, 16 and 19 (quinacridone red), 23 and 38, C.I. Pigment Blue 1, 2 and 15 (phthalocyanine blue R), 15:1, 15:2 and 15:3 (phthalocyanine blue G), 15:4 and 15:6 (phthalocyanine blue E), 16 and 17:127 (iron blue), 28 (cobalt blue), 29 (ultramarine blue), 56, 60 and 63, and C.I. Pigment Green 1, 4, 7, 8, 10, 17, 18 and 36. It is also possible to use, besides the above pigments, processed pigments, such as graft carbon having a surface treated with a resin or the like.

The amount of addition of the pigment is preferably about 0.5 to 15% by weight. The particle diameter of the pigment is preferably 25 $\mu$m or less, particularly preferably 1 $\mu$m or less.

If necessary, the addition of a dispersant in an amount of 1 to 100% by weight based on the pigment followed by a dispersion treatment with a ball mill or the like may be effected for the purpose of homogeneously dispersing the pigment.

Examples of the dye include a direct dye, an acid dye, a basic dye and a food dye. Preferred specific examples of dyes include C.I. Direct Black 9, 17, 19, 22, 32, 51, 56, 62, 69, 77, 80, 91, 94, 97, 108, 112, 113, 114, 117, 118, 121, 122, 125, 132, 146, 154, 166, 168, 173 and 199, C.I. Direct Red 2, 4, 9, 23, 26, 31, 39, 62, 63, 72, 75, 76, 79, 80, 81, 83, 84, 89, 92, 95, 111, 173, 184, 207, 211, 212, 214, 218, 221, 223, 224, 225, 226, 227, 232, 233, 240, 241, 242, 243 and 247, C.I. Direct Violet 7, 9, 47, 48, 51, 66, 90, 93, 94, 95, 98, 100 and 101, C.I. Direct Yellow 8, 9, 11, 12, 27, 28, 29, 33, 35, 39, 41, 44, 50, 53, 58, 59, 68, 86, 87, 93, 95, 96, 98, 100, 106, 108, 109, 110, 130, 132, 142, 144, 161 and 163, C.I. Direct Blue 1, 10, 15, 22, 25, 55, 67, 68, 71, 76, 77, 78, 80, 84, 86, 87, 90, 98, 106, 108, 109, 151, 156, 158, 159, 160, 168, 189, 192, 193, 194, 199, 200, 201, 202, 203, 207, 211, 213, 214, 218, 225, 229, 236, 237, 244, 248, 249, 251, 252, 264, 270, 280, 288, 289 and 291, C.I. Acid Black 7, 24, 29, 48, 52:1, 172, C.I. Acid Red 35, 42, 52, 57, 62, 80, 82, 111, 114, 118, 119, 127, 128, 131, 143, 151, 154, 158, 249, 254, 257, 261, 263, 266, 289, 299, 301, 305, 336, 337, 361, 396 and 397, C.I. Acid Violet 5, 34, 43, 47, 48, 90, 103 and 126, C.I. Acid Yellow 17, 19, 23, 25, 39, 40, 42, 44, 49, 50, 61, 64, 76, 79, 110, 127, 135, 143, 151, 159, 169, 174, 190, 195, 196, 197, 199, 218, 219, 222 and 227, C.I. Acid Blue 9, 25, 40, 41, 62, 72, 76, 78, 80, 82, 92, 106, 112, 113, 120, 127:1, 129, 138, 143, 175, 181, 205, 207, 220, 221, 230, 232, 247, 258, 260, 264, 271, 277, 278, 279, 280, 288, 290 and 326, C.I. Basic Black 8, C.I. Basic Red 12, 13, 14, 15, 18, 22, 23, 24, 25, 27, 29, 35, 36, 38, 39, 45 and 46, C.I. Basic Violet 1, 2, 3, 7, 10, 15, 16, 20, 21, 25, 27, 28, 35, 37, 39, 40 and 48, C.I. Basic Yellow 1, 2, 4, 11, 13, 14, 15, 19, 21, 23, 24, 25, 28, 29, 32, 36, 39 and 40, C.I. Basic Blue 1, 3, 5, 7, 9, 22, 26, 41, 45, 46, 47, 54, 57, 60, 62, 65, 66, 69 and 71, C.I. Disperse Yellow 3, 5, 56, 60, 64 and 160, C.I. Disperse Red 4, 5, 60, 72, 73 and 91, C.I. Disperse Blue 3, 7, 56, 60, 79 and 198, C.I. Disperse Orange 13 and 30, C.I. Food Black, C.I. Solvent Black 3, 5 and 22, C.I. Solvent Yellow 19, 44, 98, 104, 105, 112, 113 and 114, C.I. Solvent Red 8, 24, 71, 109, 152, 155, 176, 177 and 179, C.I. Solvent Blue 2, 11, 25, 78, 94 and 95, C.I. Solvent Green 26, C.I. Solvent Orange 5, 40, 45, 72, 63, 68 and 78, C.I. Solvent Violet 13, 31, 32 and 33.

The amount of addition of the dye is preferably about 0.2 to 10 by weight, still preferably about 0.5 to 5 by weight.

Specific examples of the additive include a resin emulsion which is an emulsion comprising water as its continuous phase and a resin component as its disperse phase. The resin components include, for example, polyacrylate, polymethacrylate, polyethacrylate, styrene-butadiene copolymer, butadiene polymer, acrylonitrile-butadiene copolymer, chloroprene polymer, bridged acrylic resin, bridged styrene resin, fluorine resin, vinylidene fluoride, benzoguanamine resin, phenolic resin, polyolefin, styrene-acrylate copolymer, styrene-methacrylate copolymer, polystyrene, styrene-acrylamide copolymer, n-isobutylacrylate resin acrylonitrile resin, vinyl acetate resin, acrylamide resin, silicone resin, polyvinyl acetal resin, rosin resin, polyethylene, polycarbonate, vinylidene chloride resin, epoxy resin, vinyl acetate resin, ethylene-vinyl acetate resin, vinyl acetate-acrylate copolymer, vinyl chloride resin and polyurethane. It is possible to use a low molecular resin emulsion which includes, for example, polyethylene wax, montan wax, alcohol wax, synthetic oxide wax, $\alpha$-olefin-dehydrate maleate copolymer, carnauba wax, lanolin wax, paraffin wax and microcrystalline wax.

It is also possible to use a water-soluble polymer as the additive. Specific examples of the water soluble polymer include, for example, polyalkene oxide such as polyethylene oxide, polyvinyl pyrrolidone, polyvinyl alcohol, polyvinyl butyral, polyacrylic acid, glue, gelatin, casein, albumin, acacia gum, alginic acid, methyl cellulose, carboxylmethyl cellulose, hydroxymethyl cellulose, polyvinyl ether, polyvinylmethyl ether, polyethylene glycol, and saccharides such as glucose, xylose, sucrose, maltose, arabinose, $\alpha$-cyclodextrin and starch.

Specific examples of another additive include water-soluble anionic, cationic, amphoteric and nonionic surfactants. The addition of the surfactant to the ink composition lowers the surface tension of the ink, which enables the applicability of the ink composition to the elastic layer of the intermediate transfer medium to be improved from the side of the ink composition. Preferred examples of the anionic surfactant include a salt of a higher fatty acid, a salt of a higher alkyldicarboxylic acid, a salt of a higher alcohol sulfuric acid ester, a salt of a higher alkylsulfonic acid, a salt of an alkylbenzenesulfonic acid, a salt of an alkylnaphthalenesulfonic acid, a formalin polycondensate of a salt (Na, K, Li or Ca) of naphthalenesulfonic acid, a condensate of a higher fatty acid with an amino acid, a salt of a dialkylsulfosuccinic acid ester, a salt of an alkylsulfosuccinic acid, a salt of naphthenic acid, a salt of an alkyl ether carboxylic acid, an acylated peptide, a salt of an $\alpha$-olefinsulfonic acid, N-acylmethyltaurine, a salt of an alkylethersulfuric acid, a secondary higher alcohol ethoxysulfate, a salt of a polyoxyethylene alkylphenyl ether sulfonic acid, a monoglysulfate, a salt of an alkyl ether phosphoric acid ester and a salt of an alkylphosphoric acid ester.

Preferred examples of the cationic surfactant include an aliphatic amine salt, a quaternary ammonium salt, a sulfonium salt and a phosphonium salt.

Specific preferred examples of the amphoteric surfactant include a carboxybetaine type surfactant, a salt of aminocarboxylic acid and lecithin.

Specific preferred examples of the nonionic surfactant include a fluorine surfactant, a silicone surfactant, a copolymer of acrylic acid, polyoxyethylene alkyl ether, polyoxyethylene alkylphenyl ether, polyoxyethylene secondary alcohol ether, polyoxyethylene sterol ether, a lanolin derivative of polyoxyethylene, an ethylene oxide derivative of a formalin condensate of an alkylphenol, a polyoxyethylene/polyoxypropylene block polymer, a fatty acid ester of a polyoxyethylene polyoxypropylene alkyl ether polyoxyethylene compound, a polyethylene oxide condensation type polyethylene glycol fatty acid ester, a fatty acid monoglyceride, a polyglycerin fatty acid ester, a sorbitan fatty acid ester, a propylene glycol fatty acid ester, a sucrose fatty acid ester, a fatty acid alkanolamide, a polyoxyethylene fatty acid amide and a polyoxyethylene alkylamine oxide.

The amount of addition of these surfactants is preferably about 0.05 to 10% by weight, still preferably about 0.1 to 8% by weight, based on the ink.

If necessary, pH adjusters, such as potassium dihydrogenphosphate and sodium dihydrogenphosphate, and fungicides, preservatives and rust preventives, such as benzoic acid, dichlorophene, hexachlorophene, sorbic acid, a p-hydroxybenzoic acid ester, ethylenediaminetetraacetic acid (EDTA), sodium dehydroacetate, 1,2-benzothiazolin-3-one, 3,4-isothiazolin-3-one, etc. may be added to the ink composition used in the present invention. Further, urea, thiourea, ethyleneurea, etc. may be added for the purpose of preventing the nozzle from drying.

Further, it is also preferred to add a water-soluble resin or a water-insoluble resin in an emulsion form.

The viscosity of the ink composition used in the present invention is preferably 50 mPa. sec or less, particularly preferably 25 mPa. sec or less, from the viewpoint of ensuring stable ejection of the ink from the nozzle and stable supply of the ink to the head.

EXAMPLES

The present invention will now be described in more detail with reference to the following Examples, though it is not limited to these Examples only.

Example A

An intermediate transfer ink jet recording device shown in FIG. 1 wherein an elastic layer comprising a silicone rubber was provided on the surface of the intermediate transfer medium is used. Various surfactants were coated on the surface of the intermediate transfer medium to evaluate the formation of an ink image on the intermediate transfer medium and the transfer efficiency of the ink image.

The formulation of the ink composition used is as follows.

Pigment (carbon black) 1.5 wt. %

Resin emulsion 15 wt. % (styrene/acrylic copolymer emulsion)

Diethylene glycol 6 wt. %

Sugar (glucose) 20 wt. %

Surfactant (TW-20 manufactured 3 wt. % by Dai-Ichi Kogyo Seiyaku Co., Ltd.)

Other additives and water To 100 wt. %

Surfactants used, HLB values thereof and the results of evaluation are given in the following table.

The formation of an ink image and the transfer efficiency were evaluated according to the following five grades. Grade 3 is the advantageous limit for the view point of a lower weight and a smaller size of the recording device.

Formation of Ink Image

Line printing and solid printing were effected, and the resultant ink image was evaluated based on whether or not repelling was observed in the ink image. The criteria of the evaluation were as follows.

5: An image could be formed without occurrence of repelling in both the line and solid printing.

4: Although an image could be formed without occurrence of repelling in the line printing, repelling was somewhat observed in the solid printing.

3: Although an image could be formed without occurrence of repelling in the line printing, repelling was observed in approximately half of the printed region in the solid printing.

2: Although an image could be formed without occurrence of repelling in the line printing, repelling was observed in more than half of the printed region in the solid printing.

1: Repelling was observed in both the line printing and solid printing with disturbance of an ink image.

Transfer Efficiency

The transfer efficiency was evaluated based on the transfer pressure (a linear load) necessary for transferring 100% of the ink image formed on the transfer medium to the recording paper. The criteria of the evaluation were as follows.

5: 0.5 kg/cm or less

4: more than 0.5 to 1.0 kg/cm or less

3: more than 1.0 to 2.5 kg/cm or less

2: more than 2.5 to 3.0 kg/cm or less

1: more than 3.0 kg/cm

TABLE 1

| No. | Surfactant | HLB Value | Image Formation | Transfer Efficiency |
|---|---|---|---|---|
| A1 | L-722 | 1 | 2 | 5 |
| 2 | FZ-2171 | 2 | 4 | 5 |
| 3 | L-7001 | 7 | 5 | 5 |
| 4 | L-7602 | 8 | 5 | 5 |
| 5 | FZ-2164 | 8 | 5 | 5 |
| 6 | FZ-2163 | 13 | 3 | 4 |
| 7 | L-7604 | 13 | 4 | 5 |
| 8 | FZ-2162 | 16 | 3 | 2 |
| 9 | FZ-2161 | 20 | 3 | 2 |
| 10 | Noigen EA-50 | 6 | 3 | 3 |
| 11 | EA-140 | 14 | 3 | 3 |
| 12 | Sorgen 30 | 4 | 4 | 4 |
| 13 | TW-20 | 17 | 3 | 2 |
| 14 | Epan 420 | 9 | 3 | 3 |
| 15 | 740 | 13 | 3 | 3 |
| 16 | FC-430 | 12 | 5 | 4 |
| 17 | Neocol YSK | 11 | 3 | 4 |
| 18 | Hitenol N-17 | 14 | 3 | 3 |
| 19 | Silicone oil | 0 | 1 | 5 |
| 20 | Glycerin | 20 | 2 | 1 |
| 21 | Uncoated: silicone rubber | — | 1 | 3 |

Example B

A rubber material produced by compounding a surfactant specified in the following table with a rubber for forming an elastic layer specified in the following table and vulcanizing the compounded rubber was used to form the elastic layer of the intermediate transfer drum of the device shown in FIG. 1. Further, a device provided with an elastic layer not containing a surfactant and a device using an iron-oxide-containing silicone rubber produced according to the description of U.S. Pat. No. 5,099,256 were also provided. Printing was effected using these devices. Formulations of the ink compositions used and specified in the following table are as follows.

Ink composition 1

Pigment (carbon black) 3 wt. %

Resin emulsion 8 wt. % (styrene/acrylic copolymer emulsion)

Glycerin 8 wt. %

Polyvinyl pyrrolidone 6 wt. %

Surfactant (TW-20 manufactured 1 wt. % by Dai-Ichi Kogyo Seiyaku Co., Ltd.)

Other additives and water To 100 wt. %

Ink composition 2

Pigment (carbon black) 3 wt. %

Resin emulsion 8 wt. % (Watersol CD-540 manufactured by Dainippon Ink and Chemicals Inc.)

Triethanolamine 5 wt. %

Triethylene glycol 5 wt. %

Other additives and water To 100 wt. %

TABLE 2

| No. | Surfactant (HLB value and amount of addition) | Elastic Layer | Ink Composition |
|---|---|---|---|
| B1 | FC-430 (12, 2 wt. %) | Silicone rubber | 1 |
| 2 | FC-430 (12, 5 wt. %) | Silicone rubber | 1 |
| 3 | FC-430 (12, 13 wt. %) | Silicone rubber | 1 |
| 4 | Sodium dialkylsulfo-succinate (7 to 12, 5 wt.%) | Chloroprene rubber | 2 |
| 5 | None | Silicone rubber | 1 |
| 6 | None | Chloroprene rubber | 2 |
| 7 | None | Silicone rubber containing iron oxide* | 1 |

Note)*Prepare as described in U.S. Pat. No. 5,099,256

The formation of an ink image and the transfer efficiency were evaluated as follows.

Formation of Ink Image

Line printing was effected, and the resultant ink image was evaluated based on whether or not repelling was observed in the ink image. The criteria of the evaluation were as follows. ○: An image could be formed without occurrence of repelling in both the line and solid printing. x: Repelling was observed with disturbance of an ink image.

Transfer Efficiency

The transfer efficiency was evaluated based on the transfer pressure (a linear load) necessary for transferring 100% of the ink image formed on the transfer medium to the recording paper. The criteria of the evaluation were as follows. ◎: 1 kg/cm or less ○: more than 1.0 to 2.5 kg/cm or less x: more than 3.0 kg/cm

TABLE 3

| No. | Formation of Ink Image | Transfer Efficiency |
|---|---|---|
| B1 | ○ | ○ |
| 2 | ○ | ◎ |
| 3 | ○ | ○ |
| 4 | ○ | ◎ |
| 5 | X | ○ |
| 6 | X | ○ |
| 7 | ○ | X |

What is claimed is:

1. An intermediate transfer ink jet recording apparatus comprising:

an intermediate transfer medium carrying, on a surface thereof, a surfactant having an HLB value consisting of 2 to 15, said surface comprising sufficient of the surfactant to improve a) accuracy of formation of the ink image on the intermediate transfer medium by reducing repelling of the ink image on the intermediate transfer medium, (b) efficiency of transfer of the ink image from the intermediate transfer medium to a recording medium by lowering a pressure required to transfer the ink image from the intermediate transfer medium to the recording medium or (c) both;

recording means for ejecting droplets of an ink composition to form an ink image on said intermediate transfer medium; and transfer means for pressing said ink image formed on said intermediate transfer medium against the recording medium to transfer said ink image to said recording medium.

2. The apparatus according to claim 1, which further comprises means for coating said surfactant on said intermediate transfer medium to carry said surfactant on the surface of said intermediate transfer medium.

3. The apparatus according to claim 2, wherein said recording means and said means for coating the surfactant are integrally combined.

4. The apparatus according to claim 1, wherein said surface comprises a rubber containing the surfactant.

5. The apparatus according to claim 1, which further comprises means for heating said recording medium on which said ink image has been transferred.

6. The apparatus according to claim 1 wherein the surface comprises sufficient of the surfactant to improve a) accuracy of formation of the ink image on the intermediate transfer medium by reducing repelling of the ink image on the intermediate transfer medium, b) efficiency of transfer of the ink image from the intermediate transfer medium to the recording medium by lowering a pressure required to transfer the ink image from the intermediate transfer medium to the recording medium or c) both.

7. The apparatus according to claim 1 wherein the surface comprises sufficient of the surfactant to enable accurate formation of the ink image on the intermediate transfer medium substantially without repelling in line printing and also to enable transfer of the ink image to the recording medium upon application of a pressure not exceeding about 2.5 kg/cm.

8. The apparatus according to claim 7, wherein the surface consists essentially of a rubber having the surfactant coated thereon or incorporated therein.

* * * * *